US006022676A

United States Patent [19]

Schmittou et al.

[11] Patent Number: 6,022,676

[45] Date of Patent: Feb. 8, 2000

[54] PHOTOGRAPHIC FIXING COMPOSITION WITH MIXTURE OF FIXING AGENTS AND METHOD OF RAPID PROCESSING

[75] Inventors: Eric R. Schmittou, Rochester; David G. Foster, W. Henrietta, both of N.Y.

[73] Assignee: Eastman Kodak Company, Rochester, N.Y.

[21] Appl. No.: 09/223,292

[22] Filed: Dec. 30, 1998

[51] Int. Cl.[7] ..... G03C 5/38

[52] U.S. Cl. ..... 430/459; 430/455

[58] Field of Search ..... 430/455, 458, 430/459

[56] References Cited

U.S. PATENT DOCUMENTS

| | | | |
|---|---|---|---|
| 5,183,727 | 2/1993 | Schmittou | 430/372 |
| 5,244,778 | 9/1993 | Fyson | 430/455 |
| 5,256,524 | 10/1993 | Yoshimoto et al. | 430/455 |
| 5,424,176 | 6/1995 | Schmittou et al. | 430/429 |
| 5,434,035 | 7/1995 | Craver et al. | 430/398 |
| 5,451,491 | 9/1995 | Szajewski et al. | 430/393 |
| 5,464,728 | 11/1995 | Szajewski et al. | 430/393 |
| 5,508,150 | 4/1996 | Craver et al. | 430/393 |
| 5,633,124 | 5/1997 | Schmittou et al. | 430/372 |
| 5,795,703 | 8/1998 | Ishikawa | 430/393 |
| 5,891,608 | 4/1999 | Hashimoto et al. | 430/458 |

FOREIGN PATENT DOCUMENTS

| | | |
|---|---|---|
| 0 466 510 A1 | 7/1990 | European Pat. Off. . |
| 610 763 A2 | 9/1994 | European Pat. Off. . |
| 2173743 | 7/1990 | Japan . |
| 91 60199 | 6/1997 | Japan . |

*Primary Examiner*—Hoa Van Le
*Attorney, Agent, or Firm*—J. Lanny Tucker

[57] ABSTRACT

Color photographic silver halide elements, such as color films, can be rapidly fixed using a fixing composition containing a mixture of thiosulfate and thiocyanate fixing agents in specific amounts and molar ratio. The composition also includes predominantly ammonium cations (at least 55 mol %). Besides effective and rapid silver removal (up to 60 seconds), the fixing composition also minimizes residual dye stain from sensitizing dye aggregates within the photographic elements.

19 Claims, 1 Drawing Sheet

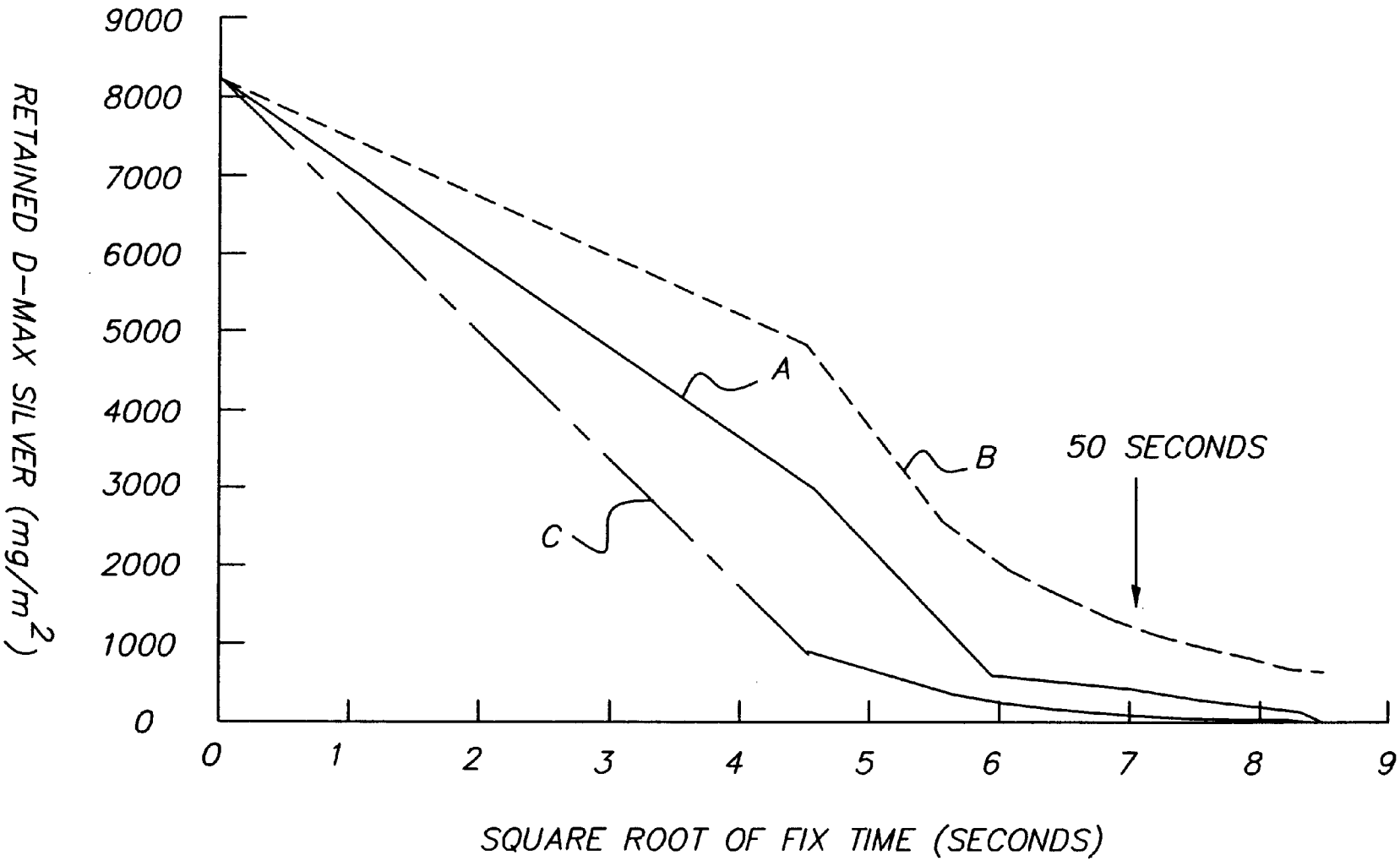
9000
8000
7000
6000
5000
4000
3000
2000
1000
0
RETAINED D-MAX SILVER (mg/m2)
0
1
2
3
4
5
6
7
8
9
SQUARE ROOT OF FIX TIME (SECONDS)
A
B
C
50 SECONDS

PHOTOGRAPHIC FIXING COMPOSITION WITH MIXTURE OF FIXING AGENTS AND METHOD OF RAPID PROCESSING

PENDING APPLICATION

Reference is made to copending and commonly assigned U.S. Ser. No. 09/223,594 filed on even date herewith by Foster and Schmittou, and entitled "Photographic Fixing Composition and Method of Rapid Photographic Processing".

FIELD OF THE INVENTION

This invention relates in general to photography. More particularly, it relates to a photographic fixing composition, and to a method of rapidly processing color photographic silver halide elements using that composition while obtaining low levels of dye density stain.

BACKGROUND OF THE INVENTION

The basic image-forming process of silver halide color photography comprises the exposure of a silver halide photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver(I) is generally removed by dissolving it in a silver(I) solvent, commonly known as a fixing agent. Conventional fixing steps generally require up to 6 minutes in large photoprocessing operations, and up to 2 minutes in small "minilabs" or small processing machines.

In some photochemical processes, bleaching and fixing are combined in a bleach-fixing step using a composition that includes both a bleaching agent to oxidize metallic silver and a fixing agent to dissolve the remaining silver(I).

A wide variety of fixing agents and silver solvents are known, as described for example in U.S. Pat. No. 5,633,124 (Schmittou et al) and publications noted therein. Thiosulfate salts are generally preferred as fixing agents because they are inexpensive, highly water soluble, non-toxic, non-odorous, and stable over a wide pH range. Thus, fixing is usually accomplished using a thiosulfate fixing agent that diffuses into the element, and forms silver thiosulfate complex that diffuses out of the element. In large photofinishing labs, the elements are usually immersed in a fixing solution for from 4 to 6 minutes. In small minilabs, fixing time is shorter, that is from 90 to 120 seconds.

In processing some photographic elements, such as color negative photographic films, there is a need to reduce density from dye stain resulting from dye aggregates formed from sensitizing dyes commonly included in the elements to increase silver halide spectral sensitivity. After the photographic elements are exposed, the spectral dyes are no longer needed, and the aggregates they form interfere with the absorption characteristics of the colored dyes that provide the final color images.

When using conventional fixing times, the unwanted dye aggregates disappear after the prescribed lengthy fixing and stabilizing (or washing) steps. However, when the fixing time is shortened, dye aggregates and resulting dye stains remain. This problem in the original image (such as color negative film images) is unacceptable in the photographic industry. It is also unacceptable for such images as color slides or transparencies, color prints or electronic images obtained from scanning original images.

It is well known that the rate of silver dissolution (or complexation) by thiosulfate fixing agents increases with increasing thiosulfate concentration until a maximum rate is reached. After this maximum rate is reached, the rate of silver dissolution decreases as the thiosulfate concentration is increased further. Consequently, other compounds are routinely incorporated into fixing solutions to act as co-fixing agents or fixing accelerators to improve silver removal. Thiocyanate is one of the most common compounds used for this purpose.

There are several fixing solutions available in the marketplace containing a combination of thiosulfate and thiocyanate for use in a 90–120 second fixing step. One such product is available as KODAK FLEXICOLOR RA Fixer Replenisher NR having thiosulfate and thiocyanate at 0.8 and 1.2 mol/l, respectively (1:1.5 molar ratio).

There are also numerous literature references to the combination of thiosulfate and thiocyanate including EP-A-0 610 763 (Buttner et al) that describes fixing for 90 to 240 seconds. However, this publication fails to appreciate the need to avoid sensitizing dye aggregate stains.

There is a continuing need to provide images in photographic elements in a more rapid fashion. The industry is attempting to provide images to customers in less time, and thus a time reduction in any of the processing steps, including fixing, is highly desirable. The combination of thiosulfate and thiocyanate in conventional amounts is insufficient to complete the desilvering process in a more rapid fashion while eliminating unwanted dye stain from sensitizing dye aggregates.

SUMMARY OF THE INVENTION

An advance is provided in the art with a fixing composition consisting essentially of:

a) from about 1.2 to about 1.6 mol/l of a thiosulfate fixing agent, and b) at least 2 mol/l of a thiocyanate fixing agent, wherein the concentration of ammonium ions is at least 55 mol % of all cations in the composition, and the molar ratio of the thiosulfate fixing agent to the thiocyanate fixing agent is from about 0.4:1 to about 0.8:1.

This fixing composition can be used in a method for photographic processing by contacting an imagewise exposed and color developed color photographic silver halide element with the fixing composition described above for up to 60 seconds.

We have found that shortened fixing times for photographic processing can be carried out with successful silver removal and reduction of sensitizing dye aggregate stain by using the specific amounts of thiosulfate and thiocyanate fixing agents. Unlike the invention described and claimed in the copending U.S. Ser. No. 09/223,597 identified above, the present invention does not require the use of an organic sulfur-substituted compound or any fixing accelerator in the fixing compositions. There are only two essential components needed for the benefits (that is, rapid fixing) of the present invention, that is the two fixing agents identified herein in the given amounts and molar ratio. Moreover, the concentration of ammonium cations in the composition should be at least 55 mol % of all cations.

In the practice of this invention, at least 95% of the original removable silver(I) is dissolved during fixing with the present invention, and the residual stain density from residual sensitizing dye aggregates is less than 0.05 density units within the region of 600–700 nm. Further details of how these advantages are accomplished are provided below.

BRIEF DESCRIPTION OF THE DRAWING

FIG. 1 is a graphical representation of data obtained in the experiments described in Example 2 below.

DETAILED DESCRIPTION OF THE INVENTION

The fixing compositions used in this invention generally have a pH of from about 4 to about 8 when in aqueous form. Preferably, the pH is from about 5 to about 8, and more preferably, it is from about 6 to about 8 as used during processing.

The fixing composition can be packaged and transported as a dry or liquid formulation, working strength solution, or as a single-part concentrated composition. It can be used as a replenisher as well as the initial tank working solution.

It should be understood that the fixing compositions of this invention are intended for rapid and efficient removal of silver(I) from photographic elements, either before, during or after bleaching or any combination of these. In the case of bleach-fixing, the fixing composition of this invention can also include useful amounts of one or more bleaching agents (such as iron chelates) that are purposely added to the fixing composition in some manner. Preferably, however, the useful fixing compositions have fixing activity only (no purposely added bleaching agents), and the only bleaching agents that may be present in the fixing composition are those carried over from a preceding bleaching solution by the photographic element being processed.

The first essential component in the fixing composition is a thiosulfate fixing agent that can be provided as sodium thiosulfate, potassium thiosulfate, ammonium thiosulfate, lithium thiosulfate, calcium thiosulfate, or magnesium thiosulfate, or mixtures thereof such that the desired concentration of thiosulfate ion is provided. Preferably, ammonium or sodium thiosulfate (or a mixture thereof) is used.

The second essential component is a thiocyanate fixing agent that can be provided as sodium thiocyanate, potassium thiocyanate or ammonium thiocyanate, or mixtures thereof. Preferably ammonium or sodium thiocyanate (or mixtures thereof) is used.

The concentrations of the essential components of the fixing composition of this invention are listed in TABLE I below wherein all of the ranges of concentrations are considered to be approximate (that is "about").

TABLE I

| COMPONENT | GENERAL CONCENTRATION (mol/l) | PREFERRED (MORE) CONCENTRATIONS (mol/l) |
|---|---|---|
| Thiosulfate ions | 1.2–1.6 | 1.25–1.5 |
| Thiocyanate ions | ≧2 | 2–3 (2–2.5 more preferred) |
| Molar ratio of thiosulfate to thiocyanate | 0.4:1–0.8:1 | 0.45:1–0.75:1 (0.5:1–0.6:1 more preferred) |
| Ammonium ions | ≧55 mol % of all cations | ≧75 mol % of all cations |

Optional addenda that can be present in the fixing composition if desired are materials that do not materially affect the photographic fixing function. Such materials include, but are not limited to, conventional biocides, a source of sulfite or bisulfite ion as preservatives, alky- or arylsulfinic acids or their salts, halides (such as bromide ions, chloride ions or iodide ions), photographic hardeners, metal ion sequestering agents, buffers, and other materials readily apparent to one skilled in the photographic art. These and other optional materials can be present in conventional amounts (e.g. as described in U.S. Pat. No. 5,633,124, noted above and incorporated herein by reference).

The components of the fixing composition of this invention can be mixed together in any suitable order as would be known in the art, and stored indefinitely or used immediately as liquid or solid formulations. They can be formulated in aqueous concentrates such that dilution up to 10 times is required during use. Alternatively, they can be formulated as solid composition (tablets, pellets, powders and the like) and added to a processing tank with appropriate amounts of water for use.

During photographic processing, conventional procedures can be used for replenishment of the various processing solutions, including the fixing solution. Preferably, the rate of fixing solution replenishment is not more than 3000 $ml/m^2$, and preferably from about 250 to about 1500 $ml/m^2$ of processed photographic film. The processing equipment can be any suitable processor having one or more processing tanks or vessels, including minilab processors and larger scale processors. The fixing step can be carried out in one or more tanks or stages arranged in concurrent or countercurrent flow. Generally, fixing is carried out in a two-tank or two-stage processing configuration, but single-tank or single-stage processing can also be used.

The present invention can be used advantageously with any of the known methods of applying fixing compositions to photographic elements. These methods include, but are not limited to, immersing the element into an aqueous fixing solution (with or without agitation or circulation), bringing the element into contact with a web or drum surface that is wet with the fixing composition, laminating the element with a cover sheet or web in such a way that fixing composition is brought into contact with the element, or by applying the fixing composition to the element by high velocity jet or spray.

The fixing step can be carried out at a temperature of from about 20 to about 60° C. (preferably from about 30 to about 50° C.). The time of processing during this fixing step is generally up to 60, and preferably at least 30 and up to 50 seconds. Optimal processing conditions are at 30° C. or higher temperatures. In some embodiments, higher fixing temperatures, for example from about 35 to about 55° C. can provide even more rapid fixing and minimize dye stain in the practice of this invention.

The other processing steps can be similarly rapid or conventional in time and conditions. Preferably, the other processing steps such as color development, bleaching and stabilizing (or rinsing) are likewise shorter than conventional times. For example, color development can be carried out for from about 12 to about 150 seconds, bleaching for from about 12 to about 50 seconds, and stabilizing (or rinsing) for from about 15 to about 50 seconds in rapid processing protocols. The fixing step can be carried out more than once in some processes. These processing methods can have any of a wide number of arrangement of steps, as described for example in U.S. Pat. No. 5,633,124 (noted above). In such rapid processing methods, the total processing time for example for color negative films can be up to 300 seconds (preferably from about 120 to about 300 seconds), and the total processing time for color negative papers can be up to 100 seconds (preferably from about 50 to about 100 seconds).

More rapid fixing times and reduced sensitizing dye aggregate stain can be brought about by higher fixing temperature, lower overall silver coverage in the processed elements, reduced silver iodide in the processed elements, reduced amounts of sensitizing dyes (especially the cyan colored dye aggregates), using sensitizing dyes with increased aqueous solubility or decreased strength of adsorption to silver halide, thinner processed elements or a greater swollen thickness to dry thickness ratio of the processed elements. Also, lower silver and/or halide (especially iodide) concentrations in the seasoned fixing composition can bring about the desired results.

The present invention can therefore be used to process silver halide elements of various types including color papers (for example, EKTACOLOR RA4), color motion picture films and print films (for example, Process ECP, Process ECN and Process VNF-1), and color negative (for example, Process C-41) or color reversal (for example, Process E-6) films, with or without a magnetic backing layer or stripe. The various processing sequences, conditions and solutions for these processing methods are well known in the art. Preferably, color negative films (including those having a magnetic backing layer) are processed using this invention.

The emulsions and other components, and element structure of photographic materials used in this invention and the various steps used to process them are well known and described in considerable publications, including, for example, Research Disclosure, publication 38957, pages 592–639 (September 1996) and hundreds of references noted therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. The invention can be practiced with photographic films containing any of many varied types of silver halide crystal morphology, sensitizers, color couplers, and addenda known in the art, as described in the noted Research Disclosure publication and the many publications noted therein. The films can have one or more layers, at least one of which is a silver halide emulsion layer that is sensitive to electromagnetic radiation, disposed on a suitable film support (typically a polymeric material).

The processed color negative films may have a magnetic recording layer, or stripe, on the support opposite the silver halide emulsion layer(s). Formulations for preparing magnetic recording layers are also well known in the art, as described for example, in *Research Disclosure,* publication 34390, November, 1992, U.S. Pat. No. 5,395,743 (Brick et al), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding or laminating.

Various supports can be used for such color negative films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane-4,4'-dicarboxylate and polybutylene terephthalate are preferred. These materials can be subbed or unsubbed and coated with various antihalation, antistatic or other non-imaging layers as is known in the art. Particularly useful antistatic layers on the backside of the elements include vanadium pentoxide in a suitable binder.

Representative photographic elements that can be processed to advantage using the present invention include, but are not limited to, KODAK ROYAL GOLD Color Films (especially the 1000 speed color film), KODAK GOLD MAX 400 and 800 Color Films, KODAK ADVANTIX Color Films, KODAK VERICOLOR III Color Films, KONICA VX400 Color Film, KONICA Super SR400 Color Film, FUJI SUPER HG400 Color Film, FUJI SUPERG 200 Color Film and LUCKY GBR100 Color Film. Other elements that could be used in the practice of this invention would be readily apparent to one skilled in the art.

Reagents for color developing compositions are well known, and described, for example, in *Research Disclosure* (noted above), sections XVIII and XIX, and the many references described therein. Thus, besides a color developing agent, the color developers can include one or more buffers, antioxidants (or preservatives, such as hydroxylamine and sulfo-, carboxy- and hydroxy-substituted mono- and dialkylhydroxylamines), antifoggants, fragrances, solubilizing agents, brighteners, halides, sequestering agents and other conventional addenda. Representative teaching about color developing compositions can also be found in U.S. Pat. No. 4,170,478 (Case et al), U.S. Pat. No. 4,264,716 (Vincent et al), U.S. Pat. No. 4,482,626 (Twist et al), U.S. No. 4,892,804 (Vincent et al), and U.S. Pat. No. 5,491,050 (Brust et al).

Some useful organic substituted hydroxylamines include mono- or dialkylhydroxylamines having one or more hydroxy substituents on the one or more alkyl groups. Representative compounds of this type are described for example in U.S. Pat. No. 5,709,982 (Marrese et al), incorporated herein by reference with respect to these compounds.

Bleaching compositions are also well known, as described for example, in *Research Disclosure* (noted above), section XX and the many references noted therein. Common bleaching agents for such compositions include, but are not limited to, ferric salts or ferric binary or ternary complexes of aminopolycarboxylic acids of many various structures including but not limited to ethylenediaminetetraacetic acid, iminodiacetic acid, methyliminodiacetic acid, ethylenediaminedisuccinic acid (either the S,S isomer, or a racemic mixture of isomers), ethylenediaminemonosuccinic acid, and others as described for example in U.S. Pat. No. 5,334,491 Roster et al), U.S. Pat. No. 5,582,958 (Buchanan et al), U.S. Pat. No. 5,585,226 (Strickland et al), U.S. Pat. No. 5,652,085 (Wilson et al), U.S. Pat. No. 5,670,305 (Gordon et al), and U.S. Pat. No. 5,693,456 (Foster et al), all incorporated herein by reference.

Stabilizing and rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gormel), U.S. Pat. No. 4,923,782 (Schwartz), U.S. Pat. No. 4,927,746 (Schwartz), U.S. Pat. No. 5,278,033 (Hagiwara et al), U.S. Pat. No. 5,441,852 (Hagiwara et al), U.S. Pat. No. 5,529,890 (McGuckin et al), U.S. Pat. No. 5,534,396 (McGuckin et al), U.S. Pat. No. 5,578,432 (McGuckin et al), U.S. Pat. No. 5,645,980 (McGuckin et al), and U.S. Pat. No. 5,716,765 (McGuckin et al), all incorporated herein by reference.

Processing according to the present invention can be carried out using conventional tanks holding processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

The following examples are included for illustrative purposes only. Unless otherwise indicated, the percentages are by weight.

EXAMPLE 1

Fixing compositions having varying amounts of ammonium thiosulfate and ammonium thiocyanate were formulated. Each composition also contained disodium ethylenediaminetetraacetic acid (1 g/l), anhydrous sodium sulfite (20 g/l), silver bromide (8.7 g/l), ammonium iodide (0.68 g/l), and either acetic acid or ammonium hydroxide to achieve a pH of 6.5. Ammonium ions comprised at least 92 mol % of all cations in the composition.

Samples of KODAK GOLD MAX 800 Color Film were processed after neutral exposure through a 21 step-wedge exposure target using the processing method and solutions shown in TABLE II.

TABLE II

| PROCESSING STEP | PROCESSING SOLUTION | PROCESSING TIME |
|---|---|---|
| Color development | KODAK FLEXICOLOR Color Developer* | 3 minutes, 15 seconds |
| Bleaching | KODAK FLEXICOLOR Bleach III* | 4 minutes, 20 seconds |
| Water washing | Water | 3 minutes, 15 seconds |
| Fixing | As noted in TABLE III | 50 seconds |
| Stabilizing | KODAK FLEXICOLOR Stabilizer LF* | 1 minute, 5 seconds |

*Commercially available from Eastman Kodak Company

The processing solutions were agitated with bursts of nitrogen bubbles and maintained as 37.8° C. in each processing step. Film samples were treated with the fixing composition for 50 seconds. After processing, the amount of unwanted dye stain density was determined by measuring the maximum optical density of the sensitizing dye aggregates in the region of from 600 to 700 nm in a spectrophotometric scan of the minimum density ($D_{min}$) in the film samples. A dye stain density of 0.05 unit or less is considered acceptable because at this level the dye stain density is insufficient to cause noticeable dye stain. TABLE III shows the dye stain density measurements using various amounts of fixing agents. Moreover, the method of this invention successfully removed at least 95% of the original silver from the processed film samples as determined using conventional techniques.

TABLE III

| Ammonium thiosulfate (mol/l) | Ammnonium thiocyanate (mol/l) | Thiosulfate: Thiocyanate Molar Ratio | Dye Stain Density (units) | Comments |
|---|---|---|---|---|
| 1.00 | 1.00 | 1:1 | 0.271 | Comparison |
| 1.00 | 1.75 | 0.57:1 | 0.229 | Comparison |
| 1.00 | 2.50 | 0.4:1 | 0.100 | Comparison |
| 1.25 | 1.00 | 1.25:1 | 0.300 | Comparison |
| 1.25 | 1.75 | 0.71:1 | 0.100 | Comparison |
| 1.25 | 2.50 | 0.5:1 | 0 | Invention |
| 1.50 | 1.00 | 1.5:1 | 0.329 | Comparison |
| 1.50 | 1.75 | 0.86:1 | 0.171 | Comparison |
| 1.50 | 2.50 | 0.6:1 | 0.043 | Invention |

The data in TABLE III show dye stain densities at the various amounts and molar ratios of fixing agents. Acceptably low dye stain density (0.05 or less) was observed only when the thiosulfate fixing agent was present at from about 1.2 to about 1.6 mol/l, the thiocyanate fixing agent was present at from about 2 to about 3 mol/l, and the molar ratio of the two compounds was from about 0.45:1 to about 0.65:1. Thus, all three conditions must be met for the rapid fixing to be achieved with acceptable residual sensitizing dye aggregate stain.

EXAMPLE 2

This example compares the performance of a fixing composition of this invention to the use of Control fixing compositions comprising only a thiosulfate fixing agent or a thiocyanate fixing agent under rapid fixing conditions.

Fixing compositions containing silver ion (5 g/l), iodide ion (0.6 g/l) and ammonium sulfite (20 g/l) and one or more fixing agents were prepared and used to process samples of KODAK GOLD MAX 800 Color Negative Film as described in Example 1 above. The Invention fixing composition contained ammonium thiosulfate (1.25 mol/l) and ammonium thiocyanate (2.5 mol/l). The Control A fixing composition contained only ammonium thiosulfate (1.25 mol/l), and the Control B fixing composition contained only ammonium thiocyanate (2.5 mol/l). Fixing was carried out for 50 seconds, and the amount of silver retained in the film samples was measured using conventional techniques at various points during the processing step.

FIG. 1 shows the results of retained silver with fixing time. It can be seen that after 50 seconds of fixing, only the fixing composition of the present invention (Curve C) acceptably removed silver from the processed film samples. Use of the Control A (Curve A) and Control B (Curve B) fixing compositions did not provide the desired results.

EXAMPLE 3

Evaluation of Ammonium Cations Concentrations

Samples of KODAK Gold Max 800 Color Film were given a $D_{min}$ and $D_{max}$ exposure through a suitable test object and then processed as follows at 37.8° C. using conventional Process C41 conditions and processing solutions and various fixing compositions.

| | |
|---|---|
| Process C-41 Color Development | 195 seconds |
| Process C-41 Bleaching | 240 seconds |
| Water Washing | 180 seconds |

-continued

| | |
|---|---|
| Fixing | 50 or 60 seconds |
| Water Washing | 180 seconds |
| PHOTOFLO Rinsing | 60 seconds |

The fixing compositions were agitated using a vigorous and constant stream of nitrogen bubbles from the bottom of the fixing tank. There was only a 1–2 second crossover time between the fixing composition and the water washings. After processing, the film samples were analyzed by visible transmission spectrophotometry to measure dye stain density in the region between 600 and 700 nm. Sensitizing dye aggregate stain density is the difference between the maximum density of the film with dye aggregate stain and the density of the film without dye aggregate stain in the region between 600 and 700 nm. This measurement is made with the greatest sensitivity in a $D_{min}$ area of the film sample.

Residual silver levels were measured after processing in a $D_{max}$ area of the film samples using a conventional X-ray fluorescence method.

The tested fixing composition contained the following components:

| | |
|---|---|
| Ammonium thiosulfate | 200 g/l |
| Ammonium sulfite | 14.2 g/l |
| Sodium sulfite | 10.0 g/l |
| FDTA-4Na* | 1 g/l |
| Silver bromide | 16.7 g/l |
| Silver iodide | 0.93 g/l |
| Sodium thiocyanate | 2.0 or 2.75 mol/l |
| pH | 6.5 |
| Water to 1 liter | |

*EDTA is ethylenediaminetetraacetic acid.

The following TABLE IV lists the dye stain densities and residual silver levels observed after various fixing times using the various fixing compositions containing two different sodium thiocyanate concentrations.

TABLE IV

| Sodium Thio-cyanate mol/l | Ammonium Cation Percentage | Fixing Time (seconds) | Dye Stain Density (density units) | Residual Silver ($\mu m/cm^2$) | Comment |
|---|---|---|---|---|---|
| 2.75 | 50% | 50 | 0.100 | 11.6 | Comparison |
| 2.0 | 57% | 50 | 0.038 | 9.5 | Invention |
| 2.75 | 50% | 60 | 0.000 | 6.3 | Comparison |
| 2.0 | 57% | 60 | 0.000 | 6.1 | Comparison |

The results in TABLE IV show that in spite of the higher concentration of thiocyanate (2.75 mol/l), the dye stain density is excessive and residual silver is higher after 50 seconds of fixing when the ammonium cation content of the fixing composition is only 50% of its total cation content. Yet when the ammonium ion content is 57%, the dye stain density is at a satisfactory low level and silver removal is more complete, even though the thiocyanate concentration is less. At a fixing time of 60 seconds or greater, the dye stain density is eliminated even with a lower ammonium ion content and the advantages of a higher ammonium ion percentage are not achieved. Thus, the advantages of this invention are realized when the ammonium cation content is greater than or equal to 55% of the total cation content of the fixer and the fixing time is less than 60 seconds.

EXAMPLE 4

Evaluation of Fixing Temperatures

Samples of KODAK Gold Max 800 Color Film were given a $D_{min}$ and $D_{max}$ exposure through a suitable test object and then processed as follows at 37.8° C. using conventional Process C-41 conditions and solutions except for fixing as noted below:

| | |
|---|---|
| Process C-41 color development | 195 seconds |
| Process C-41 bleaching | 240 seconds |
| Water washing | 180 seconds |
| Fixing | 30 or 40 seconds |
| Water washing | 180 seconds |
| PHOTOFLO Rinsing | 60 seconds |

Fixing was carried out at 37.8° C. and 48.9° C. as noted below. Fixing agitation was accomplished by a vigorous and constant rotation of the film samples in contact with the fixing composition. There was a 1 second crossover time between fixing and water washing. After processing, the film samples were analyzed by visible transmission spectrophotometry to measure sensitizing dye aggregate stain density in the region between 600 and 700 nm as described in Example 3 above. Residual silver levels were also measured as described in Example 3 above.

The fixing compositions contained the following components:

| | |
|---|---|
| Ammonium thiosulfate | 200 g/l |
| Ammonium sulfite | 14.2 g/l |
| Sodium sulfite | 10.0 g/l |
| EDTA-4Na | 1 g/l |
| Silver bromide | 16.7 g/l |
| Silver iodide | 0.93 g/l |
| pH | 6.5 |
| Water to 1 liter | |

The fixing composition optionally contained ammonium thiocyanate or sodium thiocyanate at 2.75 mol/l as shown below. TABLE V below lists the dye stain densities and residual silver levels observed after various fixing times and temperatures.

TABLE V

| Thiocyanate Fixing Agent | Fixing Temperature | Ammonium Cation Percentage | Fixing Time (seconds) | Dye Stain Density (density units) | Residual Silver ($\mu g/cm^2$) | Comment |
|---|---|---|---|---|---|---|
| None | 37.8° C. | 95% | 30 | 0.388 | 47.9 | Comparison |
| Ammonium, 2.75 mol/l | 37.8° C. | 97% | 30 | 0.163 | 13.5 | Invention |
| Sodium, 2.75 mol/l | 37.8° C. | 50% | 30 | 0.088 | 43.3 | Comparison |
| None | 37.8° C. | 95% | 40 | 0.338 | 32.8 | Comparison |
| Ammonium, 2.75 mol/l | 37.8° C. | 97% | 40 | 0.025 | 1.5 | Invention |

TABLE V-continued

| Thiocyanate Fixing Agent | Fixing Temperature | Ammonium Cation Percentage | Fixing Time (seconds) | Dye Stain Density (density units) | Residual Silver ($\mu g/cm^2$) | Comment |
|---|---|---|---|---|---|---|
| Sodium, 2.75 mol/l | 37.8° C. | 50% | 40 | 0.275 | 18.1 | Comparison |
| None | 48.9° C. | 95% | 30 | 0.225 | 22.9 | Comparison |
| Ammonium, 2.75 mol/l | 48.9° C. | 97% | 30 | 0.000 | 0.0 | Invention |
| Sodium, 2.75 mol/l | 48.9° C. | 50% | 30 | 0.325 | 10.8 | Comparison |
| None | 48.9° C. | 95% | 40 | 0.325 | 3.4 | Comparison |
| Ammonium, 2.75 mol/l | 48.9° C. | 97% | 40 | 0.000 | 0.0 | Invention |
| Sodium, 2.75 mol/l | 48.9° C. | 50% | 40 | 0.063 | 0.0 | Comparison |

TABLE V shows the expected results that desilvering is improved by fixing at a higher temperature. But unexpectedly, dye stain densities are not effectively eliminated at short fixing times at higher temperatures unless a thiocyanate is present in an inventive amount and the ammonium content of the fixing composition is greater than about 55% of the total cations in the composition.

The results also show that dye stain densities can be effectively reduced at even shorter fixing times up to 50 seconds using a fixing composition containing a thiocyanate and a thiosulfate when the percentage of ammonium ion is higher than 55% of total cations. The fixing composition having 97% ammonium ions effectively reduced dye stain densities in as few as 40 seconds at 37.8° C. and in as few as 30 seconds at 48.9° C. Without thiocyanate present in an inventive amount, the fixing composition having 95% ammonium ions did not eliminate dye stain densities under these temperature and time conditions. Without ammonium ions present in at least about 55% of the total cations, the fixing composition containing thiocyanate does not effectively eliminate dye stain densities under these temperature and fixing time conditions.

The invention has been described in detail with particular reference to preferred embodiments thereof, but it will be understood that variations and modifications can be effected within the spirit and scope of the invention.

We claim:

1. A fixing composition consisting essentially of:

a) from about 1.2 to about 1.6 mol/l of a thiosulfate fixing agent, and b) at least 2 mol/l of a thiocyanate fixing agent, wherein the concentration of ammonium ions is at least 55 mol % of all cations in said composition, and the molar ratio of said thiosulfate fixing agent to said thiocyanate fixing agent is from about 0.4:1 to about 0.8:1.

2. The fixing composition of claim 1 that is an aqueous composition having a pH of from about 4 to about 8.

3. The fixing composition of claim 2 having a pH of from about 6 to about 8.

4. The fixing composition of claim 1 wherein said thiocyanate fixing agent is present at a concentration of from about 2 to about 2.5 mol/l.

5. The fixing composition of claim 1 wherein said thiosulfate fixing agent is present at a concentration of from about 1.25 to about 1.5 mol/l, and said thiocyanate fixing agent is present at a concentration of from about 2 to about 3 mol/l.

6. The fixing composition of claim 1 wherein the concentration of ammonium ions is at least 75 mol % of all cations.

7. An aqueous fixing composition having a pH of from about 6 to about 8, and consisting essentially of:

a) from about 1.25 to about 1.5 mol/l of a thiosulfate fixing agent, and b) from about 2 to about 3 mol/l of a thiocyanate fixing agent, wherein the concentration of ammonium ions comprises at least 75 mol % of all cations in said composition, the molar ratio of said thiosulfate fixing agent to said thiocyanate fixing agent is from about 0.45:1 to about 0.75:1, and said fixing composition contains no purposely added bleaching agents.

8. The fixing composition of claim 7 wherein the molar ratio of said thiosulfate fixing agent to said thiocyanate fixing agent is from about 0.5:1 to about 0.6:1.

9. A method of photographic processing comprising:

contacting an imagewise exposed and color developed color photographic silver halide element with the fixing composition of claim 1 for up to 60 seconds.

10. The method of claim 9 wherein said element has been bleached before contacting with said fixing composition.

11. The method of claim 9 wherein said contacting is carried out for up to 50 seconds.

12. The method of claim 9 wherein said contacting is carried out for from about 30 to about 50 seconds.

13. The method of claim 9 wherein at least 95 mol % of the original removable silver(I) in said element is dissolved during said contacting step, and the residual sensitizing dye aggregate stain after contacting with said fixing composition is less than 0.05 density units of dye stain in the region of 600 to 700 nm.

14. The method of claim 9 wherein said color photographic silver halide element is a color negative film.

15. The method of claim 9 wherein said contacting is carried out at a temperature of from about 20 to about 60° C.

16. A method of photographic processing comprising:

A) color developing of an imagewise exposed color negative film with a color development composition comprising a color developing agent, B) bleaching said color developed color negative film with a bleaching composition comprising a bleaching agent, C) fixing said bleached color negative film for up to 50 seconds with a fixing composition having a pH of from about 4 to about 8, and consisting essentially of:

a) from about 1.25 to about 1.5 mol/l of a thiosulfate fixing agent, and b) from about 2 to about 3 mol/l of a thiocyanate fixing agent, wherein the concentration of ammonium ions is at least 75 mol % of all cations in said composition, and the molar ratio of said thiosulfate fixing agent to said thiocyanate fixing agent is from about 0.45:1 to about 0.75:1, and D) rinsing or stabilizing said fixed color negative film with a rinsing or stabilizing composition.

17. The method of claim 16 wherein said color developing is carried out for from about 12 to about 150 seconds, said bleaching is carried out for from about 12 to about 50 seconds, said fixing is carried out for from about 30 to about 50 seconds, and said rinsing or stabilizing is carried out for from about 15 to about 50 seconds.

18. The method of claim 16 that is carried out for from about 120 to about 300 seconds for steps A through D.

19. The method of claim 16 wherein step C is carried out at a temperature of from about 30 to about 50° C.

* * * * *